US008776534B2

(12) United States Patent
Dunn et al.

(10) Patent No.: US 8,776,534 B2
(45) Date of Patent: Jul. 15, 2014

(54) GAS BALANCED CRYOGENIC EXPANSION ENGINE

(75) Inventors: Stephen Dunn, Allentown, PA (US); Ralph Longsworth, Allentown, PA (US); John Borchers, Coplay, PA (US)

(73) Assignee: Sumitomo (SHI) Cryogenics of America Inc., Allentown, PA (US)

( * ) Notice: Subject to any disclaimer, the term of this patent is extended or adjusted under 35 U.S.C. 154(b) by 73 days.

(21) Appl. No.: 13/106,218

(22) Filed: May 12, 2011

(65) Prior Publication Data

US 2012/0285181 A1 Nov. 15, 2012

(51) Int. Cl.
*F25B 9/00* (2006.01)

(52) U.S. Cl.
CPC ..... *F25B 9/00* (2013.01)
USPC ..... 62/6

(58) Field of Classification Search
CPC ..... F25B 9/00; F25B 9/14; F25B 9/06; F25B 9/145; F01B 21/04; F04B 37/08
USPC ..... 62/6, 600, 401, 403, 55.5, 474
See application file for complete search history.

(56) References Cited

U.S. PATENT DOCUMENTS

| | | | | |
|---|---|---|---|---|
| 2,607,322 | A | 8/1952 | Collins | |
| 3,045,436 | A | 7/1962 | Gifford et al. | |
| 3,438,220 | A | 4/1969 | Collins | |
| 3,609,982 | A * | 10/1971 | O'Neil et al. | 62/6 |
| 3,613,385 | A * | 10/1971 | Hogan et al. | 62/6 |
| 3,708,979 | A * | 1/1973 | Bush et al. | 60/522 |
| 4,372,128 | A | 2/1983 | Sarcia | |
| 5,092,131 | A | 3/1992 | Hattori et al. | |
| 5,181,383 | A * | 1/1993 | Goto et al. | 62/6 |
| 5,355,679 | A | 10/1994 | Pierce | |
| 5,361,588 | A | 11/1994 | Asami et al. | |
| 5,481,878 | A | 1/1996 | Shaowei | |
| 5,711,157 | A * | 1/1998 | Ohtani et al. | 62/6 |
| 6,053,202 | A * | 4/2000 | Cunningham | 137/596.16 |
| 6,202,421 | B1 | 3/2001 | Maguire et al. | |
| 6,205,791 | B1 | 3/2001 | Smith, Jr. | |
| 6,216,467 | B1 * | 4/2001 | O'Neil et al. | 62/6 |

(Continued)

FOREIGN PATENT DOCUMENTS

| | | |
|---|---|---|
| JP | 2007522371 | 8/2007 |
| KR | 100636474 | 10/2006 |
| KR | 1020090031436 | 3/2009 |

OTHER PUBLICATIONS

International Search Report and the Written Opinion of the International Searching Authority dated Aug. 27, 2012 from the corresponding International Application No. PCT/US2012/029432.

(Continued)

*Primary Examiner* — Frantz Jules
*Assistant Examiner* — Emmanuel Duke
(74) *Attorney, Agent, or Firm* — Katten Muchin Rosenman LLP

(57) ABSTRACT

An expansion engine operating on a Brayton cycle which is part of a system for producing refrigeration at cryogenic temperatures that includes a compressor, a counter-flow heat exchanger, and a load that may be remote, which is cooled by gas circulating from the engine. The engine has a piston in a cylinder which has nearly the same pressure above and below the piston while it is moving. Low pressure on a piston drive stem provides a force imbalance to move the piston towards the warm end.

13 Claims, 3 Drawing Sheets

(56) References Cited

U.S. PATENT DOCUMENTS

| | | | | |
|---|---|---|---|---|
| 6,256,997 | B1 | 7/2001 | Longsworth | |
| 2003/0168618 | A1* | 9/2003 | Coney et al. | 251/48 |
| 2005/0000232 | A1* | 1/2005 | Longsworth | 62/6 |
| 2007/0119188 | A1 | 5/2007 | Xu et al. | |

OTHER PUBLICATIONS

File History of U.S. Appl. No. 61/313,868, filed Mar. 15, 2010.
File History of U.S. Appl. No. 61/391,207, filed Oct. 8, 2010.

* cited by examiner

GAS BALANCED CRYOGENIC EXPANSION ENGINE

BACKGROUND OF THE INVENTION

1. Field of the Invention

This invention relates to an expansion engine operating on the Brayton cycle to produce refrigeration at cryogenic temperatures.

2. Background Information

A system that operates on the Brayton cycle to produce refrigeration consists of a compressor that supplies gas at a discharge pressure to a counterflow heat exchanger, from which gas is admitted to an expansion space through an inlet valve, expands the gas adiabatically, exhausts the expanded gas (which is colder) through in outlet valve, circulates the cold gas through a load being cooled, then returns the gas through the counterflow heat exchanger to the compressor.

U.S. Pat. No. 2,607,322 by S. C. Collins, a pioneer in this field, has a description of the design of an early expansion engine that has been widely used to liquefy helium. The expansion piston is driven in a reciprocating motion by a crank mechanism connected to a fly wheel and generator/motor. The intake valve is opened with the piston at the bottom of the stroke (minimum cold volume) and high pressure gas drives the piston up which causes the fly wheel speed to increase and drive the generator. The intake valve is closed before the piston reaches the top and the gas in the expansion space drops in pressure and temperature. At the top of the stroke the outlet valve opens and gas flows out as the piston is pushed down, driven by the fly wheel as it slows down. Depending on the size of the fly wheel it may continue to drive the generator/motor to output power or it may draw power as it acts as a motor.

The inlet and outlet valves are typically driven by cams connected to the fly wheel as shown in U.S. Pat. No. 3,438,220 to S. C. Collins. This patent describes a mechanism, which is different from the earlier patent, that couples the piston to the fly wheel in a way that does not put lateral forces on the seals at the warm end of the piston.

U.S. Pat. No. 5,355,679 to J. G. Pierce describes an alternate design of the inlet and outlet valves which are similar to the '220 valves in being cam driven and having seals at room temperature.

U.S. Pat. No. 5,092,131 to H. Hattori et al describes a Scotch Yoke drive mechanism and cold inlet and outlet valves that are actuated by the reciprocating piston. All of these engines have atmospheric air acting on the warm end of the piston and have been designed primarily to liquefy helium, hydrogen and air. Return gas is near atmospheric pressure and supply pressure is approximately 10 to 15 atmospheres. Compressor input power is typically in the range of 15 to 50 kW.

Lower power refrigerators typically operate on the GM, pulse tube, or Stirling cycles. Higher power refrigerators typically operate on the Brayton or Claude cycles using turbo-expanders. U.S. Pat. No. 3,045,436, by W. E. Gifford and H. O. McMahon describes the GM cycle. The lower power refrigerators use regenerator heat exchanges in which the gas flows back and forth through a packed bed, gas never leaving the cold end of the expander. This is in contrast to the Brayton cycle refrigerators that can distribute cold gas to a remote load.

The amount of energy that is recovered by the generator/motor in the '220 Collins type engine is small relative to the compressor power input so mechanical simplicity is often more important than efficiency in many applications. U.S. Pat. No. 6,202,421 by J. F. Maguire et al describes an engine that eliminates the fly wheel and generator/motor by using a hydraulic drive mechanism for the piston. The inlet valve is actuated by a solenoid and the outlet valve is actuated by a solenoid/pneumatic combination. The motivation for the hydraulically driven engine is to provide a small and light engine that can be removably connected to a superconducting magnet to cool it down. The claims cover the removable connection.

U.S. Pat. No. 6,205,791 by J. L. Smith describes an expansion engine that has a free floating piston with working gas (helium) around the piston. Gas pressure above the piston, the warm end, is controlled by valves connected to two buffer volumes, one at a pressure that is at about 75% of the difference between high and low pressure, and the other at about 25% of the pressure difference. Electrically activated inlet, outlet, and buffer valves are timed to open and close so that the piston is driven up and down with a small pressure difference above and below the piston, so very little gas flows through the small clearance between the piston and cylinder. A position sensor in the piston provides a signal that is used to control the timing of opening and closing the four valves.

If one thinks of a pulse tube as replacing a solid piston with a gas piston then the same "two buffer volume control" is seen in U.S. Pat. No. 5,481,878 by Zhu Shaowei. FIG. 3 of the '878 Shaowei patent shows the timing of opening and closing the four control valves and FIG. 3 of the '791 Smith patent shows the favorable P-V diagram that can be achieved by good timing of the relationship between piston position and opening and closing of the control valves. The area of the P-V diagram is the work that is produced, and maximum efficiency is achieved by minimizing the amount of gas that is drawn into the expansion space between points 1 and 3 of the '791 FIG. 3 diagram relative to the P-V work, (which equals the refrigeration produced).

The timing of opening and closing the inlet and outlet valves relative to the position of the piston is important to achieve good efficiency. Most of the engines that have been built for liquefying helium have used cam actuated valves similar to those of the '220 Collins patent. The '791 Smith, and '421 Maguire patents show electrically actuated valves. Other mechanisms include a rotary valve on the end of a Scotch Yoke drive shaft as shown in U.S. Pat. No. 5,361,588 by H. Asami et al and a shuttle valve actuated by the piston drive shaft as shown in U.S. Pat. No. 4,372,128 by Sarcia.

An example of the multi-ported rotary valve similar to the ones that are described in the present invention is found in U.S. patent application 2007/0119188 by M. Xu et al. U.S. Pat. No. 6,256,997 by R. C. Longsworth describes the use of "O" rings to reduce the vibration associated with the pneumatically actuated piston impacting at the ends of the stroke. This can be applied to the present invention.

Patent application Ser. No. 61/313,868 dated Mar. 15, 2010 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. Tests of the pneumatically actuated version of this concept have shown that it is not necessary to alternate the pressure on the stem between high and low to cause the piston to reciprocate but rather it is possible to maintain the pressure on the stem at low pressure. This simplifies the construction of the engine because it is now only necessary to actuate the cold high and low pressure valves.

Patent application Ser. No. 61/391,207 dated Oct. 8, 2010 by R. C. Longsworth describes the control of a reciprocating expansion engine operating on a Brayton cycle, as described in the previous application, that enables it to minimize the time to cool a mass to cryogenic temperatures.

SUMMARY OF THE INVENTION

The present invention combines features of earlier designs in new ways to achieve good efficiency. It provides a simplification of the basic design concept of our Ser. No. 61/313,868 patent application in which there is a piston with a drive stem that has a small pressure difference between the warm end, around the drive stem, and the cold end of the piston while it is moving.

The drive stem is connected to the low pressure line going to the compressor, the warm displaced volume is connected to the high pressure line from the compressor through two lines each having a check valve and a fixed or adjustable valve, the piston moves from the cold end to the warm end when the cold inlet valve is open, and moves to the cold end when the cold outlet valve is open. Adjustable valves in the two lines from the compressor high pressure line to the warm displaced volume enable the cycle to be optimized over a wide range of speeds (and temperatures). A third line can be added between the high pressure line from the compressor and the warm displaced volume that has an active or a passive valve that opens while the piston is at the cold end.

DESCRIPTIONS OF THE PREFERRED EMBODIMENTS

Figure 1:
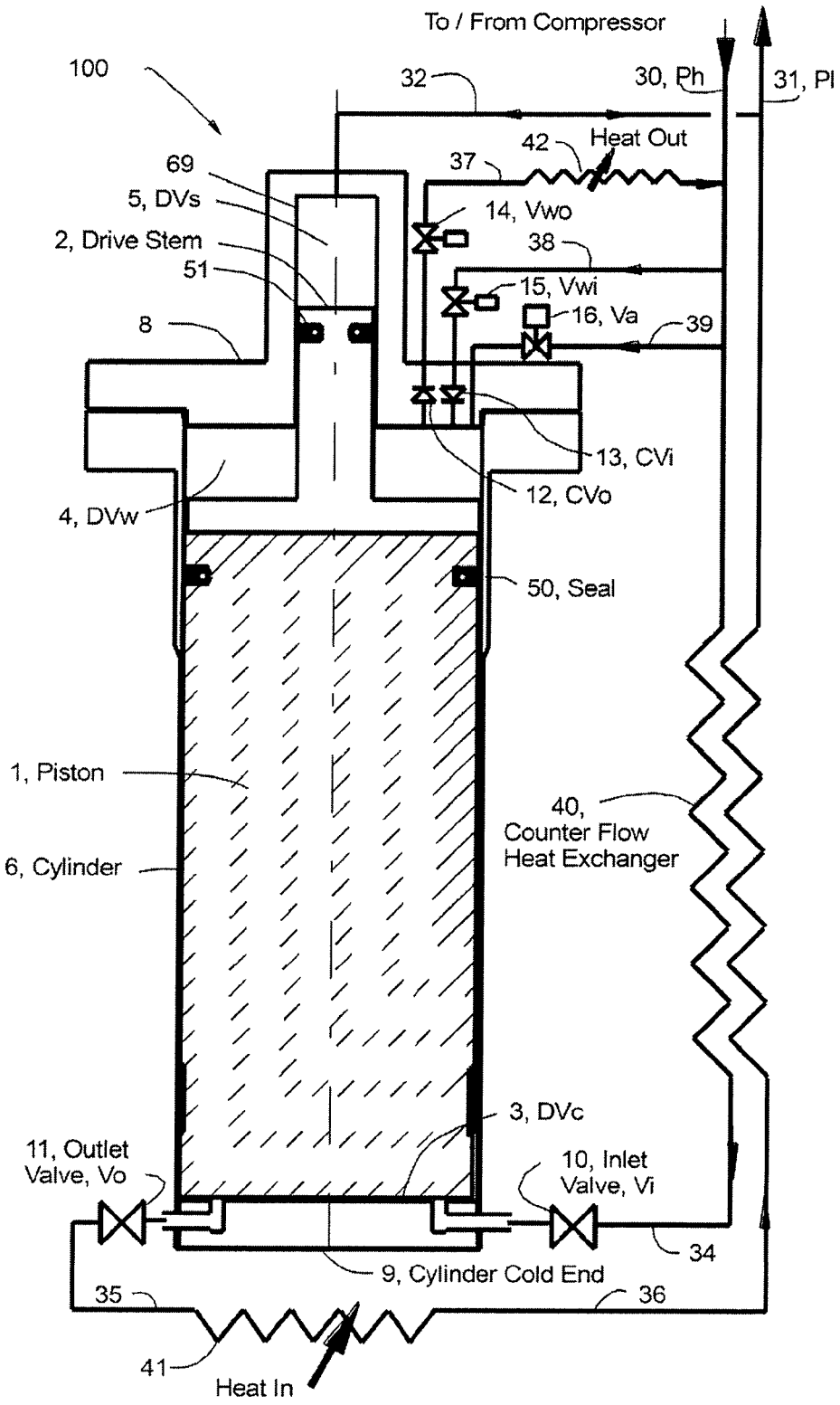
FIG. 1 shows engine 100 which has a piston in a cylinder with a drive stem at the warm end shown in a cross section, and schematic representations of the valves and heat exchangers. The schematic shows a line connected between the warm displaced volume and the compressor low pressure line with an active valve.
Figure 2:
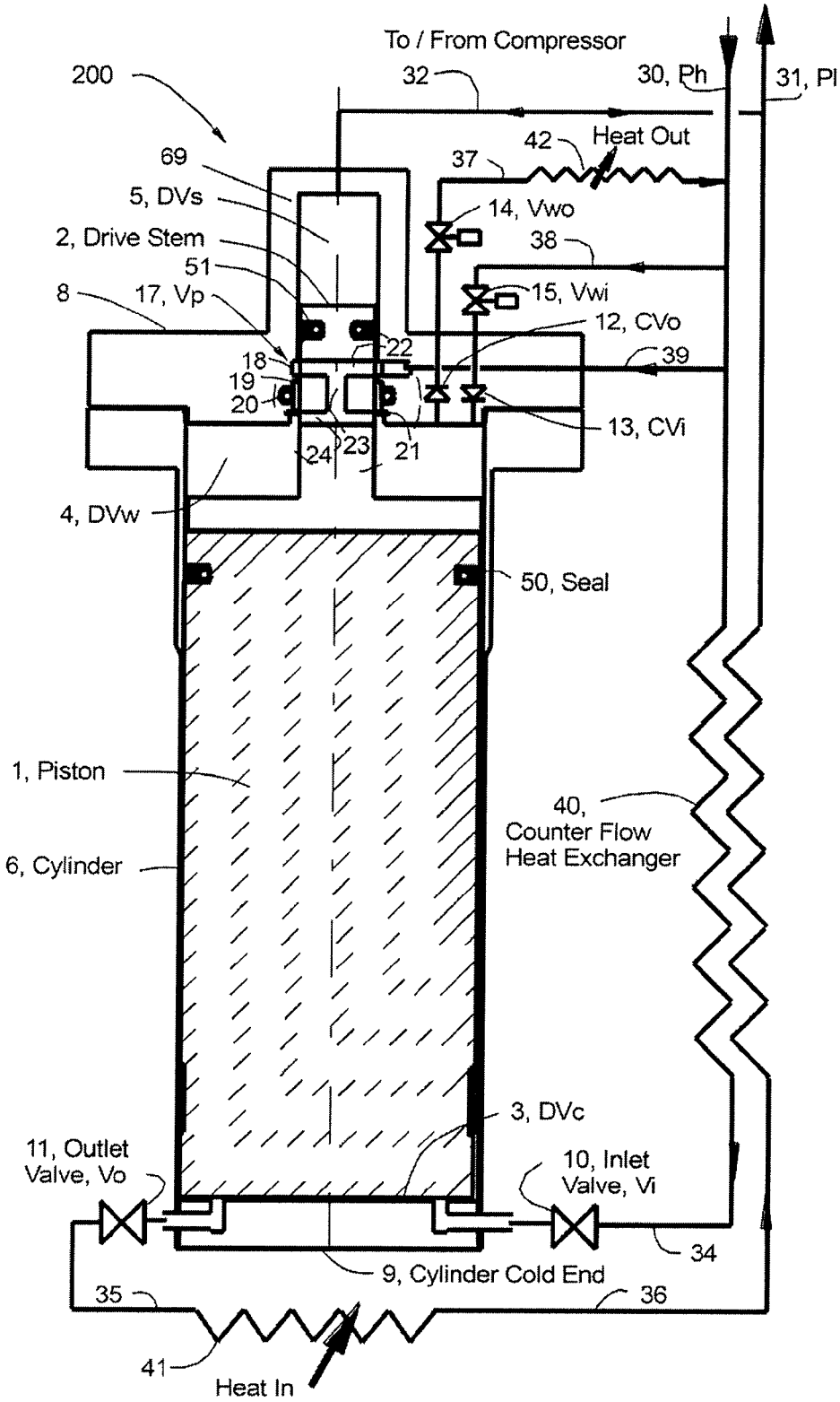
FIG. 2 shows engine 200 which has a piston in a cylinder with a drive stem at the warm end shown in a cross section, and schematic representations of the valves and heat exchangers. The schematic shows a line connected between the warm displaced volume and the compressor low pressure line with a passive valve in the drive stem.

The two embodiments of this invention that are shown in FIGS. 1 and 2 use the same number and the same diagrammatic representation to identify equivalent parts. Since expansion engines are usually oriented with the cold end down, in order to minimize convective losses in the heat exchanger, the movement of the piston from the cold end toward the warm end is frequently referred to as moving up, thus the piston moves up and down.

FIG. 1 is a cross section/schematic view of engine assembly 100. Piston 1 reciprocates in cylinder 6 which has a cold end cap 9, warm mounting flange 7, and warm cylinder head 8. Drive stem 2 is attached to piston 1 and reciprocates in drive stem cylinder 69. The displaced volume at the cold end, DVc, 3, is separated from the displaced volume at the warm end, DVw, 4, by piston 1 and seal 50. The displaced volume above the drive stem, DVs, 5, is separated from DVw by seal 51. Line 32 connects DVs, 5, to low pressure P1 in low pressure return line, 31. Line 38 connects high pressure in line 30 to DVw, 4,through adjustable valve Vwi, 15, and check valve CVi, 13. Line 37 connects DVw, 4, to high pressure in line 30 through check valve CVo, 12, and adjustable valve Vwo, 15. Warm end heat exchanger 42 is also in this line. Engine 100 is distinguished from engine 200 by active valve Va, 35, that allows gas to flow from Ph in line 30 to DVw, 4, through line 39 when it is open.

Refrigeration is produced when inlet valve Vi, 10, is opened with DVc, 3, at a minimum, pushing piston 1 up, with DVc at Ph, against a balancing pressures in DVw, then closing Vi, opening Vo, 11, expanding the gas in DVc as it flows out to P1, cooling as it expands. Gas at P1 is pushed out of DVc as piston 1 moves back towards cold end 9. Cold gas flowing out through Vo passes through line 35 to heat exchanger 41, where it is heated by the load being cooled, then flows through line 36 to counter-flow heat exchanger 40 where it cools incoming gas at Ph, prior to the high pressure gas flowing through line 34 to Vi, 10.

Prior to opening Vi, 10, the pressure in VDw, 4, is at Ph by virtue of Va, 16, having been open while piston 1 is stationary at the cold end. When Vi is opened the pressure is near Ph in DVc, 3, and DVw, 4, but the pressure in DVs, 5, is P1 which creates a force imbalance that drives piston 1 towards the warm end. Gas at a pressure slightly above the pressure in line 30 flows out through CVo, 12, and adjustable valve Vwo, 14. The speed at which piston 1 moves towards the warm end is determined by the setting of Vwo, 14. When DVw is minimum Vi, 10, is closed and Vo, 11, is opened. Gas from line 30 at Ph flows through line 38, through adjustable valve Vw, 15, and CVi, 13, into DVw, 4, pushing piston 1 towards the cold end. The speed at which piston 1 moves towards the cold end is determined by the setting of Vw, 15. The process of pressurizing DVw, 4, when Va, 16, is open causes the gas to get hot, the reverse of the process at the cold end.

A pressure maintenance assembly maintains an operating pressure on the warm end outside an area of the drive stem at about a same pressure as on the cold end while the piston is moving. The pressure maintenance assembly comprises a plurality of lines with an inlet check valve in series with a throttle valve and an outlet check valve in series with a throttle valve, the plurality of lines connected between the warm end and a high pressure line from the compressor.

This heat is removed in heat exchanger 42 when gas is pushed out through line 37.

The force imbalance created with gas at P1 on drive stem 2 and gas at Ph in DVc, 3, and DVw, 4, is needed to overcome the drop in pressure in Ph as gas flows through line 37, heat exchanger 40, and inlet valve Vi, 10. The force imbalance also overcomes friction in seals 50 and 51. In a real machine the area of drive stem 2 is typically between 5% and 15% of the area of the cold end of piston 1 and depends on how fast the engine is to be run.

FIG. 2 is a cross section/schematic view of engine assembly 200 which differs from engine assembly 100 only in replacing active valve Va, 16, with passive valve Vp, 17. Passive valve Vp, 17, is most conveniently built into drive stem 2 such that gas at Ph is admitted to DVw, 4, when piston 1 gets close to the cold end. In the embodiment shown in FIG. 2 Vp, 17, is comprised of annular groove 18 in cylinder head 8 around drive stem 2, seal collar 19 which has a sliding fit on drive stem 2 and an "O" ring seal, 20, on the outside and is held in place by retainer ring 21, and cross ports 22 and 24 connected by port 23 in drive stem 2. Gas at Ph connects from line 30 to annular groove 18 through line 33. It is admitted to DVw, 4, through Vp 17 when piston 1 is near the cold end.

Admitting gas at high pressure into DVw pushes piston 1 to the cold end, Vo, 11, still being open.

Patent application Ser. No. 61/313,868 describes a preferred construction of inlet valve Vi, 10, and outlet valve Vo, 11, both of which are pneumatically actuated at room temperature by gas cycling from a multi-ported rotary valve.

If an engine is to be used to cool down a load, and one wants to maintain a constant work out put from the compressor then it is necessary to start out at a maximum engine speed at room temperature and reduce the engine speed as it gets colder. This is done by reducing the speed of the multi-ported rotary valve and adjusting valves VWo, 14, and VWi, 15, so that piston 1 makes a full stroke but does not dwell long at the warm end, and moves towards the warm end from the cold end as soon as DVw is at Ph. Alternately it is possible to operate at constant speed with valves Vwi, 15, and Vwo, 14, at fixed positions for operation at minimum temperature. If the speed is fixed then during cool down the compressor will by-pass some gas.

Figure 3:
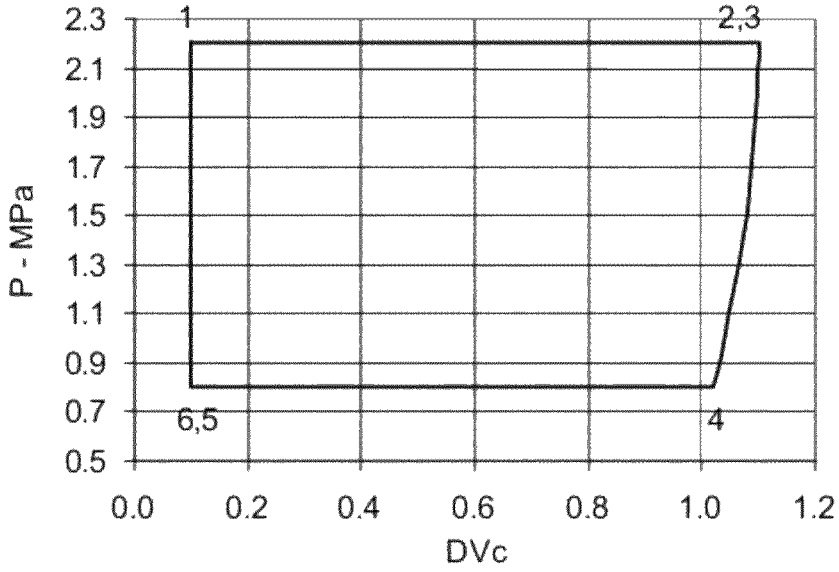
FIG. 3 shows a pressure-volume diagram for the engines shown in FIGS. 1 and 2.
Figure 4:
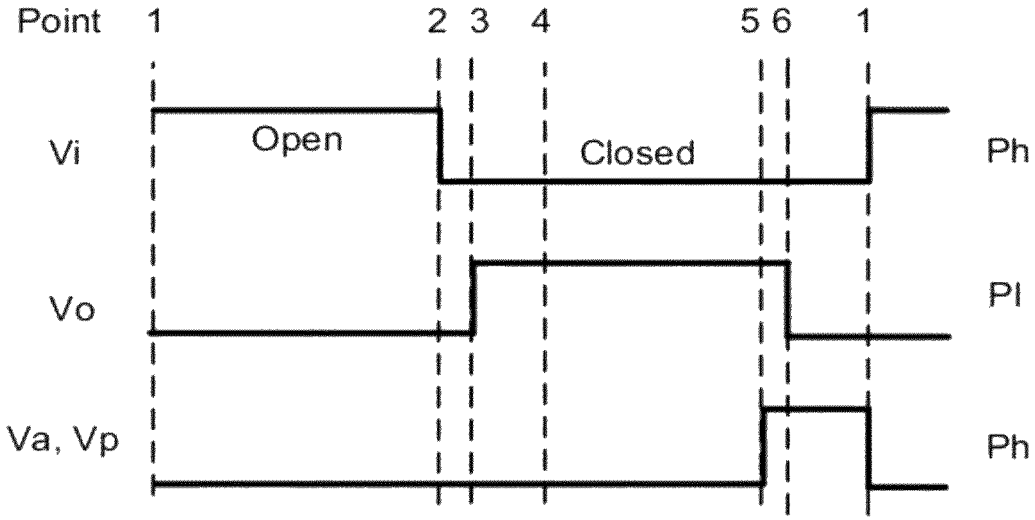
FIG. 4 shows valve opening and closing sequences for the engines shown in FIGS. 1 and 2.

FIG. 3 shows the pressure-volume diagram and FIG. 4 shows valve opening and closing sequences for the engines shown in FIGS. 1 and 2. The state point numbers on the P-V diagrams correspond to the valve open/close sequence shown in FIG. 4. The timing of the valves opening and closing is not shown, only the sequence. Point 1 on the P-V diagram represents piston 1 at the end of the stroke, minimum DVc, DVw at Ph, DVs at P1. Vi opens admitting gas at Ph to VDc. VDc increases while the gas in DVw is pushed out through line 37. At point 2 Vi is closed then Vo is opened, point 3, so the pressure in DVc drops to P1. Piston 1 moves towards the cold end a small amount to point 4 because gas at Ph in the clearance volume above the piston expands as DVc drops to P1. Gas flows into DVw through line 38 and drops in pressure from Ph to P1 as it flows through Vwi, 15, until VDc is minimum, point 5. At this point Va, 16, or Vp, 17, opens, admitting gas at Ph to VDw, 4. Point 6 is the point at which Vo, 11, is closed.

Table 1 provides an example of the refrigeration capacities that are calculated for pressures at Vi of 2.2 MPa and at Vo of 0.8 MPa. Helium flow rate is 6.0 g/s and includes flow to the valve actuators for Vi and Vo, and gas to allow for void volumes. Heat exchanger efficiency is assumed to be 98%.

The engine is assumed to have variable speed drive, a mechanism to control the speed of the piston, and valve timing to provide a full stroke with only a short dwell time at the warm end of the stroke and sufficient dwell time at the bottom to fully pressurize DVw, 4. The engine has been sized to cool down a mass from room temperature to about 30 K assuming a maximum speed when warm of 6 Hz. The optimum speed is nearly proportional to the absolute temperature.

The engine uses the assumed flow rate at the assumed pressures throughout most of the cool down. Refrigeration cooling capacity, Q, and operating speed, N, are listed for temperatures, T, at Vi of 200 K and 60 K. It is obvious that an engine could be designed to operate at a fixed speed in a narrow temperature range, such as 120 K for cooling a cryopump to capture water vapor. Engine efficiency relative to Carnot increases as it cools down, and the engine slows down, because a smaller fraction of the gas is used at the warm end. Efficiency is maximum at about 80 K, then drops because the heat exchanger losses dominate.

TABLE 1

| Calculated Performance | |
|---|---|
| Engine | 100, 200 |
| Dp - mm | 101.4 |
| S - mm | 25.4 |
| P-V Fig | 3 |
| Tc - K | 200 |
| N - Hz | 5.5 |
| Q - W | 1,250 |
| Eff - % | 8.7 |
| Tc - K | 60 |
| N - Hz | 2.0 |
| Q - W | 310 |
| Eff - % | 16.5 |

Other embodiments are within the scope of the following claims. For example line 38 with Vwi, 15, and CVi, 16, along with CVo, 12, can be eliminated if Vwo, 14, can be designed to have different characteristics for flow into DVw, 4, than flow out. Va, 16, and Vp, 17 can also be eliminated if Vwo, 14, without CVo, 12, can be opened for the short period when Va or Vp would have been opened. The cycle still produces a lot of refrigeration if the cycle timing is not ideal.

What is claimed is:

1. An expansion engine operating with a gas supplied from a compressor for producing refrigeration at cryogenic temperature, the expansion engine comprising:

a piston and a cylinder, the cylinder comprising a cold end and a warm end, the warm end comprising a cylinder shoulder and a receiving portion, the piston comprising a drive stem and a piston shoulder, the piston reciprocally moving between the cold end and the warm end and altering respective sizes of a first inner space of the at the cold end, a second inner space of the cylinder between the cylinder shoulder and the piston shoulder, and a third inner space between the receiving portion and the drive stem;

a first line connected to an inlet valve, the first line bringing high pressure gas from the compressor to the inlet valve, the inlet valve operatively connected to the first inner space for controlling admission of the high pressure gas into the first inner space when the piston is near the cold end and as the piston moves towards the warm end;

a second line connected to an outlet valve, the second line taking low pressure gas from the outlet valve to the compressor, the outlet valve operatively connected to the first inner space or exhausting the low pressure gas from the first inner space when the piston is near the warm end and as the piston moves towards the cold end; and a third line connecting the third inner space and the second line, the third line providing gas to act on the drive stem;

a pressure maintenance assembly for maintaining an operating pressure of the low pressure gas in the second inner space acting on the piston shoulder, the operating pressure being at about a same pressure as a pressure in the first inner space as the piston is moving;

wherein the pressure maintenance assembly comprises: a first branch line connecting the first line with an inlet check valve, the inlet check valve operatively connected to the second inner space; a second branch line connecting an outlet check valve with the first line, the outlet valve operatively connected to the second inner space; and further comprising a third branch line connecting the first line with the second inner space; a third valve being disposed in the third branch line to control the flow of high pressure gas to increase a pressure in the second inner space while the piston is near the cold end.

2. The expansion engine of claim 1, further comprising
a first throttle valve disposed in the first branch line and connected in series with the inlet check valve.

3. The expansion engine of claim 2, further comprising
a second throttle valve disposed in the second branch line and connected in series with the outlet check valve.

4. The expansion engine of claim 3, wherein a speed at which the piston moves between the warm end and the cold end is changed by changing a setting of the throttle valves.

5. The expansion engine of claim 1, further comprising
a second throttle valve disposed in the second branch line and connected in series with the outlet check valve.

6. The expansion engine of claim 1, wherein the third valve is an active valve or a passive valve.

7. The expansion engine of claim 1, wherein
the third branch line comprising a port in the in the drive stem,
the third valve is a passive valve.

8. The expansion engine of claim 1, further comprising a cooler in the second branch line to remove heat from the warm end.

9. An expansion engine operating with a gas supplied from a compressor for producing refrigeration at cryogenic temperatures, the gas supplied in a first line at a high pressure and returned in a second line at a low pressure, the expansion engine comprising: a cylinder having a cold end closed with a cap and a warm end closed with a cylinder head; a piston in the cylinder, the piston having a drive stem extending from the warm end into a sleeve in the cylinder head, the piston moving reciprocally between the cold end and the warm and altering respective sizes of a cold displaced volume, a warm displaced volume and a drive stem displaced volume, the drive stem displaced volume connected to a low pressure third line to the compressor, an inlet valve and an outlet valve connected to the cold displaced volume and alternating between being open and closed for admitting the high pressure gas from the compressor when the piston is near the cold end and as the piston moves towards the warm end, and exhausting it to a low pressure gas line to the compressor when the piston is near the warm end and as the piston moves towards the cold end; and a pressure maintenance assembly for maintaining an operating pressure in the warm displaced volume at a pressure sufficiently different from the pressure in the cold displaced volume to cause the piston to move, wherein the pressure maintenance assembly comprises a first branch line connecting the first line with an inlet check valve, the inlet check valve operatively connected to the warm displaced volume; a second branch line connecting an outlet check valve with the first line, the outlet valve operatively connected to the warm displaced volume; and further comprising a third branch line connecting the first line with the warm displaced volume; and one of an active and a passive a third valve disposed in the third branch line to control the flow of high pressure gas to increase a pressure in the warm displaced volume while the piston is near the cold end.

10. The expansion engine of claim 9, further comprising
a first throttle valve disposed in the first branch line and connected in series with the inlet check valve,
a second throttle valve disposed in the second branch line and connected in series with the outlet check valve.

11. The expansion engine of claim 9, wherein a passive third valve is contained in the drive stem.

12. The expansion engine of claim 9, wherein a speed at which the piston moves between the warm end and the cold end is changed by changing a setting of the throttle valves.

13. The expansion engine of claim 9, further comprising a cooler in the second branch line to remove heat from the warm end.

* * * * *